US009068382B1

(12) United States Patent
Hall

(10) Patent No.: US 9,068,382 B1
(45) Date of Patent: Jun. 30, 2015

(54) LOCKING HINGE ASSEMBLY

(71) Applicant: James E Hall, Sugar Hill, GA (US)

(72) Inventor: James E Hall, Sugar Hill, GA (US)

( * ) Notice: Subject to any disclaimer, the term of this patent is extended or adjusted under 35 U.S.C. 154(b) by 0 days.

(21) Appl. No.: 14/242,430

(22) Filed: Apr. 1, 2014

(51) Int. Cl.
*E05D 11/10* (2006.01)
*E05D 7/00* (2006.01)

(52) U.S. Cl.
CPC ..... *E05D 7/00* (2013.01)

(58) Field of Classification Search
CPC ..... E05D 11/10; E05D 2003/025; E05D 2003/027; E05Y 2900/606
USPC ..... 16/254, 328, 329, 380, 381, 386, 387
See application file for complete search history.

(56) References Cited

U.S. PATENT DOCUMENTS

| | | | | | |
|---|---|---|---|---|---|
| 353,007 | A * | 11/1886 | Schubert et al. | ..... | 16/381 |
| 737,360 | A * | 8/1903 | Daly | ..... | 403/154 |
| 1,030,801 | A * | 6/1912 | Berault | ..... | 16/262 |
| 2,057,269 | A * | 10/1936 | Schreiber | ..... | 16/263 |
| 3,068,508 | A * | 12/1962 | Heyer | ..... | 16/386 |
| 3,188,686 | A * | 6/1965 | Orcutt | ..... | 16/263 |
| 3,390,419 | A * | 7/1968 | Foltz | ..... | 16/380 |
| 3,593,365 | A * | 7/1971 | Amundsen | ..... | 16/228 |
| 3,594,073 | A * | 7/1971 | Liautaud | ..... | 351/45 |
| 4,073,037 | A * | 2/1978 | Curry et al. | ..... | 16/304 |
| 4,175,315 | A * | 11/1979 | Hayes et al. | ..... | 29/453 |
| 4,675,940 | A * | 6/1987 | Brockhaus | ..... | 16/273 |
| 5,765,263 | A * | 6/1998 | Bolinas et al. | ..... | 16/342 |
| 6,317,928 | B1 * | 11/2001 | Guillemette | ..... | 16/353 |
| 8,359,709 | B2 * | 1/2013 | Van Gennep | ..... | 16/328 |
| 2002/0078529 | A1 * | 6/2002 | Schwarz | ..... | 16/387 |
| 2012/0073083 | A1 * | 3/2012 | Staude | ..... | 16/385 |
| 2012/0242165 | A1 * | 9/2012 | Herglotz et al. | ..... | 307/104 |

* cited by examiner

*Primary Examiner* — Roberta Delisle
(74) *Attorney, Agent, or Firm* — Baker Donelson Bearman Caldwell & Berkowitz, PC

(57) ABSTRACT

A locking hinge assembly having a first hinge plate and a sleeve bushing defining a through passageway and a tooth channel with opposing side walls; a second hinge plate and a sleeve bushing, for co-axial alignment of the sleeve bushings; and a splined pin received in the aligned sleeve bushings, the splined pin having a root diameter and at least one tooth projecting therefrom for being received selectively in the tooth channel, whereby the tooth being received in the tooth channel permits rotational movement of the sleeve barrel relative to the barrel until the pin is stopped by one of the side walls of the tooth channel.

25 Claims, 4 Drawing Sheets

LOCKING HINGE ASSEMBLY

TECHNICAL FIELD

The present invention relates to hinges. More particularly, the present invention relates to hinges that mechanically cease operational movement of a barrel-type hinge assembly.

BACKGROUND OF THE INVENTION

Hinges provide mating structural elements that allow relative movement of objects to which the elements attach. Hinges are a type of bearing that connects two solid objects, and typically allow only a limited angle of rotation between them. Two objects connected by an ideal hinge rotate relative to each other about a fixed axis of rotation. A barrel hinge has a sectional barrel secured by a pivot. A barrel is a component of the hinge. The barrel is a hollow cylinder shaped section where the rotational bearing force is applied to the pivot.

While hinges have accomplished their purpose of permitting relative movement of objects to which the hinge members attach, there are drawbacks to their use. A latch extending from a handle for a door may be forced from its extended seating in a socket in a door jamb. This removes the locking feature of the handle for the door in the door frame. The door then opens on the hinges, which permits entrance to a formerly secured area.

Also, doors occasionally are partially opened, such as for ventilation, or other purposes. Secondary members may be used to hold a door partially opened. Such members, such as a wedge-shaped stop or other block device, are readily removed and the door fully opened.

Further, a hinged door may swing accurately and forcefully jam the door knob or handle into a side wall. Stops of various types are provided, such as spring members or rigid members engaged to wall trim boards and extending as door stops, angled members with adjustable stops that attach to hinges, and rubber bumpers that attach to a wall to catch the door knob and prevent damage to the wall.

Accordingly, there is a need in the art for an improved locking assembly for mechanically engaged members that in a first position locks the members from relative movement and in a second position the members are free to move relative to each other. It is to such that the present invention is directed.

SUMMARY OF THE PRESENT INVENTION

The present invention meets the need in the art by providing a locking hinge assembly, comprising a first hinge member having a hinge plate configured for attaching to a support surface and a sleeve bushing extending from an edge of the hinge plate, the sleeve bushing defining a through passageway and having a first diameter, and defining at least one tooth channel with opposing side walls, an outward wall and open to the passageway. A second hinge member having a hinge plate configured for attaching to a second support surface and a sleeve bushing extending from an edge of the hinge plate, for co-axial alignment of the sleeve bushings. An elongated splined pin received in the aligned sleeve bushings, the splined pin having a root diameter and at least one tooth projecting therefrom to define a major diameter and configured for being received selectively in the tooth channel, whereby the tooth being received in the tooth channel permits rotational movement of the sleeve barrel relative to the barrel, until the pin is stopped by one of the side walls of the tooth channel.

In another aspect, the present invention provides a locking hinge, comprising a first hinge plate configured for securely connecting to a first support surface and having a plurality of spaced-apart first sleeves. Each sleeve defines a passageway coaxially aligned with the passageways of adjacent sleeves. At least one of said sleeves having a first portion with a first inner wall surface and a second portion with a second inner wall surface. The first inner wall surface of the first sleeve defines a spline with a first diameter and the second inner wall surface having a second diameter less that the first diameter. A second hinge plate configured for securely connecting to a second support surface and having a plurality of spaced-apart second sleeves. Each second sleeve defining a passageway coaxially aligned with the passageways of adjacent second sleeves. At least one of said second sleeves having a first portion with a first inner wall surface and a second portion with a second inner wall surface. The second inner wall surface of the second sleeve defines a spline with the first diameter and the first inner wall surface of the second sleeve having the second diameter less that the first diameter. The first sleeves and the second sleeves arranged for being disposed in alternating sequence when the first hinge plate and second hinge plate are disposed with the respective sleeves coaxially aligned, the aligned sleeves thereby disposed in alternating sequence. A hinge pin received in the aligned passageways on which the first and the second hinge plates pivot so that the first and second support surfaces rotate relative to each other, the hinge pin defining at least a first and a second spline portion spaced-apart thereon for aligning with the first inner wall surface of the first sleeve and the second inner wall surface of the second sleeve respectively when the hinge pin is in a first position and the first and the second spline portion aligning with the second inner wall surface of the first sleeve and the first inner wall surface of the second sleeve when the hinge pin is in a second position. The hinge pine is biased to the first position. A latch movable between a first position to a second position holds the hinge pin in the second position.

Objects, advantages, and features of the present invention will become apparent upon a reading of the following detailed description in conjunction with the drawings and the appended claims.

DETAILED DESCRIPTION

Figure 1:
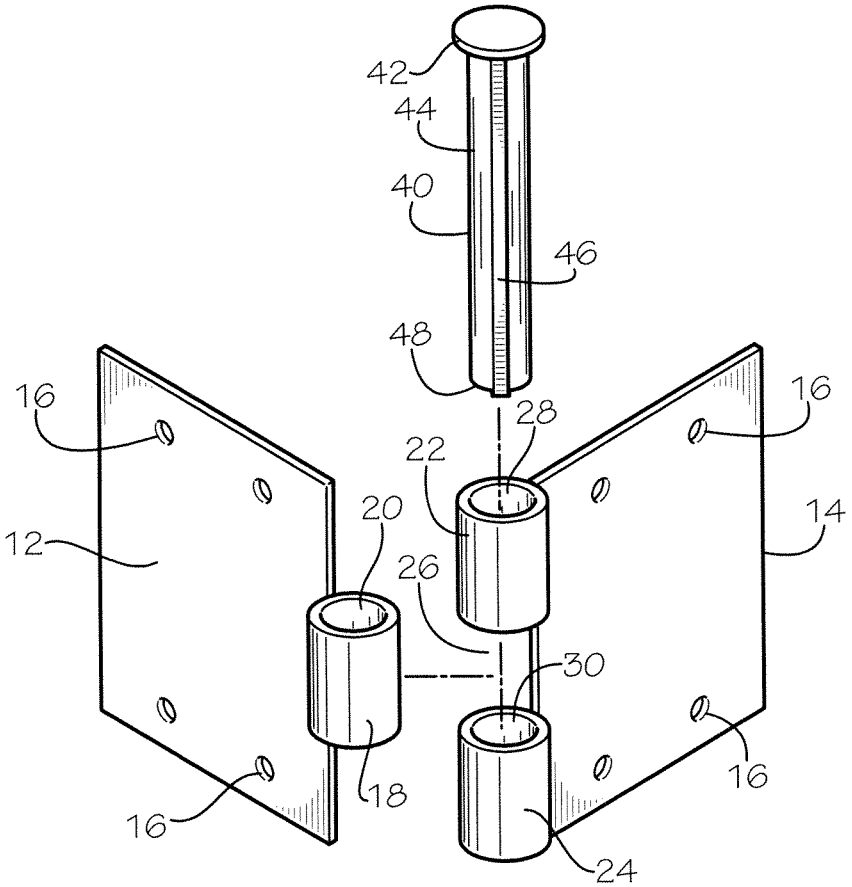
FIG. 1 illustrates in perspective view an exemplary embodiment of a locking hinge assembly in accordance with the present invention.

With reference to the drawings, in which like parts have like identifiers, FIG. 1 illustrates in perspective cut-away view a locking hinge assembly 10 in accordance with the present invention. The locking assembly 10 comprises a first plate 12 and a second plate 14 configured for attaching to respective surfaces of structures that selectively pivot or rotate relative to each other (such as door and a door jamb). In the illustrated embodiment, the plates 12, 14 define openings 16 for receiving threaded fasteners (not illustrated) to secure the plates to the surfaces. A hinge barrel 18 defining a passageway 20 attaches to an edge of the plate 12. A pair of hinge barrels 22, 24 attach in spaced relation to an edge of the plate 14 and define a gap 26. The hinge barrels 22, 24 define respective passageways 28, 30. The barrel 18 seats in the gap 26 to coaxially align the passageways 20, 28, 30 when the locking hinge assembly attaches to the surfaces. It is to be appreciated that the lengths of the barrels 18, 22, 24 are the same, and for purposes of discussion herein are 1 inch in length, and in alternate embodiments, the locking hinge assembly 10 may have barrels of other lengths and may have other number of barrels with similarly seat together with alternate gaps and barrels.

A splined hinge pin 40 extends though the aligned passageways 20, 28, 30. The splined hinge pin 40 has a cap 42 and an elongated pin 44 with a laterally extending tooth 46. The splined pin comprises an elongated shaft with at least one tooth projecting therefrom and with a plurality, the splined pin define a chord between adjacent teeth. The pin 44 has a length so that a distal end 48 extends 1 inch beyond the end of the hinge barrel 24.

Figure 2:
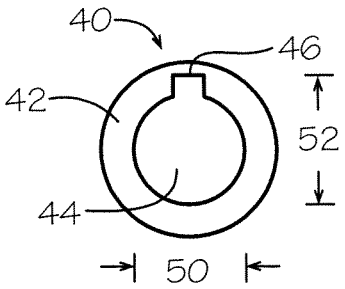
FIG. 2 illustrates in end view the pin having a projecting tooth illustrated in FIG. 1.

FIG. 2 illustrates the splined hinge pin 40 in end view. The pin 44 has a root diameter 50 (or bore diameter) and the extending tooth 46 defines an outward diameter 52 or major diameter. The root diameter 50 is less than the outward diameter 52. The spline hinge pin 40 may have a spline rather that a tooth, as discussed below. The spline, or the tooth, may extend the length of the pin, or in alternate embodiments, have one or more separate portions that extend less than the length of the pin. The separate portions define a spline portion and a gap or smooth portion, in which the spline portion has a major diameter and the alternating non-splined smooth surface portion has a root diameter.

Figure 3:
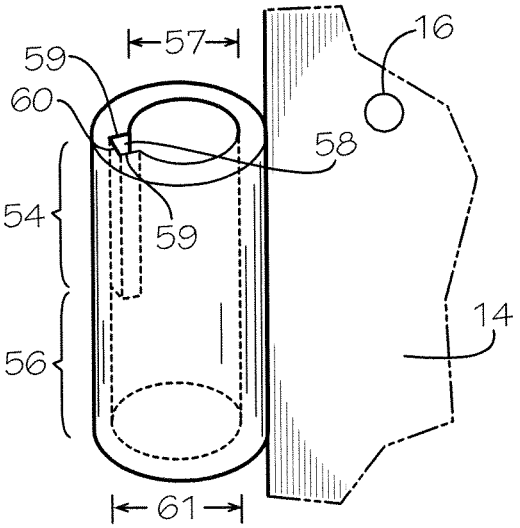
FIG. 3 illustrates in perspective view a sleeve barrel for the locking hinge assembly illustrated in FIG. 1.

FIG. 3 illustrates in detailed view the barrel 22. The barrel 22 has a first portion 54 and a second portion 56. The barrel 22 defines a longitudinal channel 58 open to the passageway 28. The channel defines opposing stop wall 59 and a radially outward side wall 60. The channel 58 extends in the first portion 54 from a first end of the barrel to the second portion 56. The passageway 28 has in the first portion 54 has a diameter 57 equal to the root diameter 50 for receiving the pin 44 therein. The outward side wall 60 of the channel 58 and the passageway 28 cooperatively define a diameter 61 equal to the outward diameter 52. The tooth 46 is received in the channel 58. The second portion 56 has the diameter 61 equal to the outward diameter 52. It is to be appreciated that a sleeved barrel may have a plurality of portions with a channel in each portion at a different radial angle for selectively positioning the hinge assembly at a selected angle.

The splined hinge pin 40 is selectively positioned within the aligned barrels. In an embodiment having the tooth extending a portion of the length of the pin, the pin may be selectively disposed for securing the opposing hinge members from relative movement or permitting relative movement. When the tooth 46 is disposed within the channel 58, the opposing stop walls 59 restrict the rotation of the hinge barrel 22 relative to the hinge barrel 18. When the tooth 46 is within the second portion 56 (having the larger diameter), the hinge barrel 22 may rotate freely relative to the hinge barrel 18. This structure allows at designated intervals for the splined pin and its outside diameter to move freely within the major diameter of the sleeve bushing. An operable locking hinge assembly permits the hinge pin to move between first and second positions for locking the assembly from relative movement and for unlocking the assembly to permit relative movement. An inoperable locking hinge assembly however provides a range of relative motion, as discussed below in reference to FIG. 5.

Figure 4:
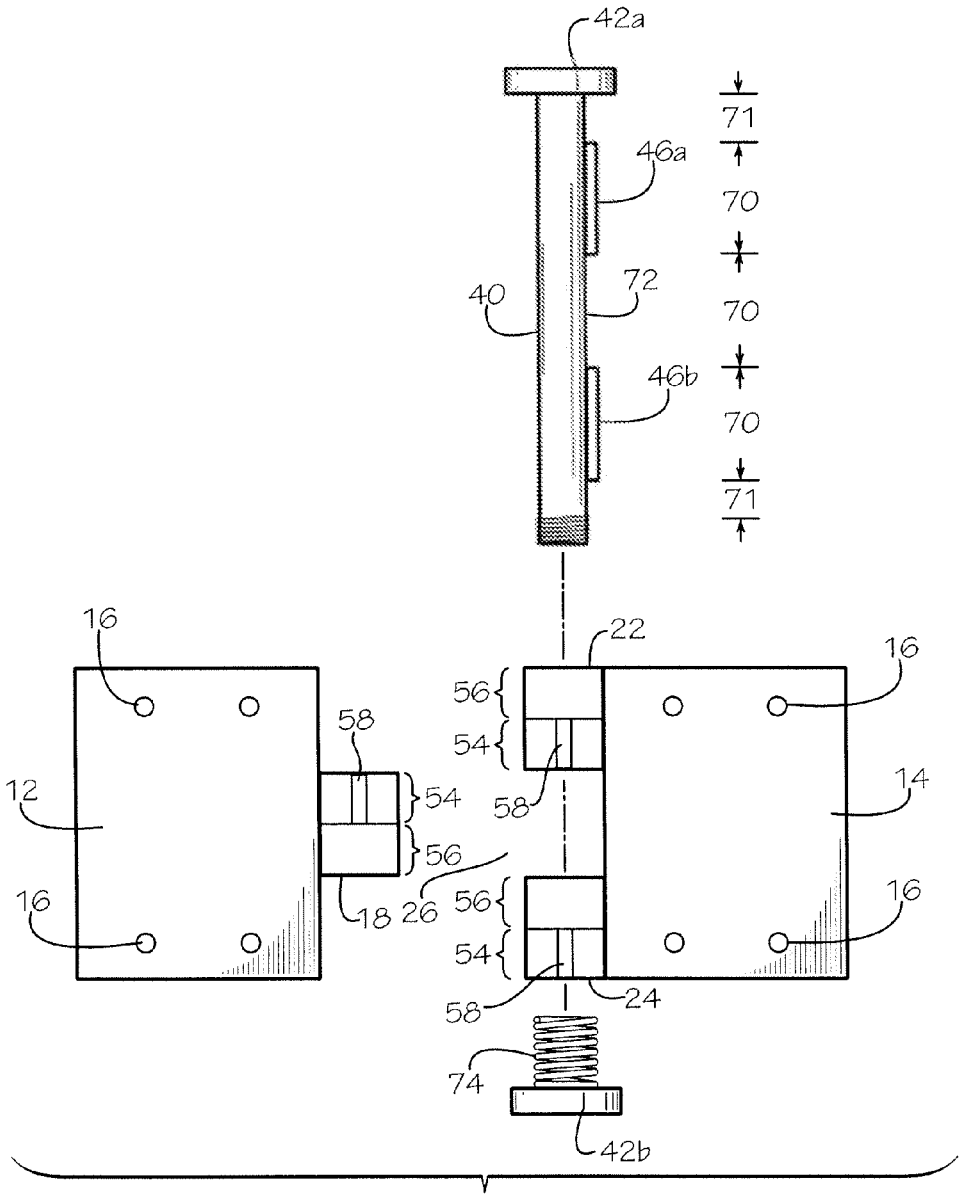
FIG. 4 illustrates in perspective view a second exemplary embodiment of a locking hinge assembly in accordance with the present invention.

FIG. 4 illustrates an exemplary embodiment of the locking hinge assembly 10. The sleeve bushing 18 (illustrated in cut-away view) on the edge of the plate 12 is inverted in opposition to the sleeve bushings 22, 24 (also illustrated in cut-away view) on the edge of the plate 14. The sleeve bushing 18 thereby disposes the first portion 54 in a first vertical position (as shown, higher than the second portion 56). The first portion 54 defines the passageway bore diameter 57 and with one channel 58 the major diameter 61. The second portion 56 defines the passageway major diameter 61. The opposing sleeve bushings 22, 24 dispose the first portions 54 in the second lower vertical position.

The splined pin 40 includes two spaced-apart teeth 46*a*, 46*b*. The teeth 46*a*, 46*b* have a length 70 (in the exemplary embodiment, 1 inch). The tooth 46*a* starts ½ length 71 from the cap 42*a*; the tooth 46*b* terminates ½ length from the cap 42*b* (when threaded on the pin 44). The separated teeth 46*a*, 46*b* define a gap 72 having the length 70. The opposing ends of the pin 44 are threaded and engage threaded caps 42. A spring 74 seats on the pin 40 between the cap 42*b* and the sleeve bushing 24.

Upon assembly the gap 26 receives the sleeve bushing 18 between the sleeve bushings 22, 24. With the hinge plates 12, 14 rotated to align the channels 58, the pin 40 slides through the aligned passageways. The distal end of the pin 40 extend beyond the sleeve bushing 24. The pin 40 receives the spring 74 which is held by threading the cap 42 to the distal end of the pin. The spring 74 biases the pin 40 to a first position with the cap 42*a* against an upper edge of the sleeve bushing 22 and the distal portion of the pin extending outwardly from the sleeve bushing 24. The first position positions the tooth 46*a* in the portions 54 of the sleeve bushings 22 and 18; the tooth 46*a* positions in the portion 54 of the sleeve bushing 24. In this first position, the plates 12, 14 are restricted from rotation relative to each other as the teeth 46*a*, 46*b* are within the channels 58. The stop walls 59 limit the relative movement by engaging the teeth 46*a*, 46*b*.

The pin 40 may be moved to a second position. The cap 42*b* is pushed against the spring 74. This moves the pin 40 axially in the aligned sleeve bushings 22, 18, 24. The tooth 46*a* moves upwardly to be within the second portion 56 of the sleeve bushing 22 with the upper ½ of the tooth outwardly of the sleeve bushing. The tooth 46*b* moves upwardly to be within the second portions 56 of the sleeve bushings 18, 24. The plates 12, 14 are free to rotate relative to each other as the teeth are in the second portions 56 having the major diameter 61.

Figure 5:
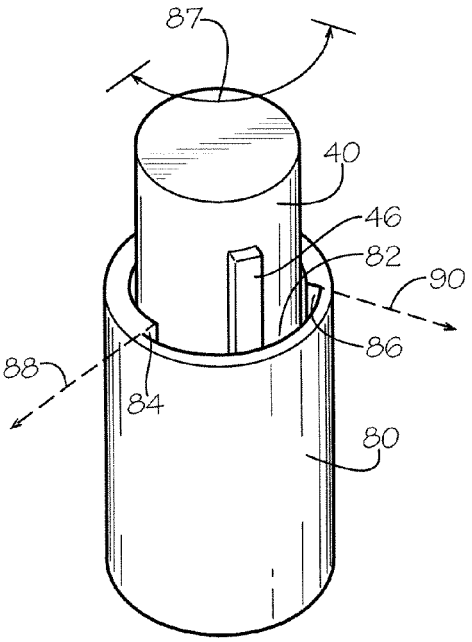
FIG. 5 illustrates in perspective detailed view an exemplary embodiment of a sleeve barrel providing a locking hinge assembly with a range of relative rotation.

FIG. 5 illustrates in perspective detailed view an exemplary embodiment of a sleeve barrel 80 that provides the locking hinge assembly with a range of relative rotation. This is accomplished by a channel 82 defined as an arc relative to the sleeve barrel 80. The channel 82 has opposing stop walls 84, 86 that are disposed on arcuately spaced radials 88, 90 of the sleeve barrel 80. The sleeve barrel 80 permits a range 87 of relative motion for the locking hinge assembly. For example, a door in a wall at a corner of a room may be permitted a substantially 90° rotation from closed with the door seated in the door jambs to an open position with the door parallel to the adjacent side wall and perpendicular to the wall having the door jambs.

Figure 6:
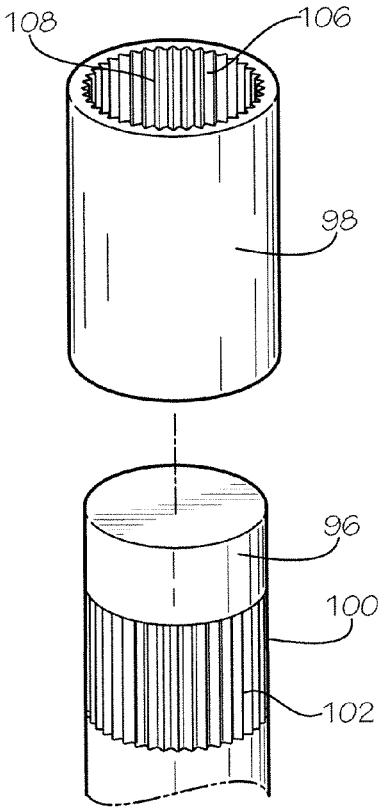
FIG. 6 illustrates in perspective view an alternate embodiment of a splined pin and a sleeve bushing in accordance with the present invention.

FIG. 6 illustrates an alternate embodiment of the locking assembly having a splined pin 96 and a spline barrel sleeve 98. The splined pin 96 is structurally similar to the pin 40 but comprises a spline 100 rather than the tooth 46. The spline 100 comprises a plurality of radially spaced teeth 102. This defines gaps between adjacent teeth 102. The spline barrel sleeve 98 is structurally similar to the barrel sleeve 18 except having a spline 106 rather than the channel 58. The spline 106 comprises a plurality of radially spaced teeth 108 that define gaps between adjacent teeth. With the pin 96 in the first position relative to the sleeve 98, the respective teeth 102 align in the defined gaps between the teeth 108 in the sleeve bushing 98 receive a respective tooth 102 and the gaps between the teeth 102 receive a respective tooth 108 of the sleeve bushing. The opposing sides of the adjacent arcuately alternating teeth 102, 108 define sidewalls that restrict relative movement of the pin 96 and the sleeve 98. Thus. the sleeve 98 attached to the plate 14 restricts relative rotation of the plates 12, 14. Further, the splines 100, 106 permit selective positioning of a hinge assembly at selected angles. For example, a spline 100, 106 having nine (9) equally spaced teeth about a 90° arc permits selective positioning of a movable member (such as a door) at a selected angle at 10° increments. Thus, a door may be held partially open with the splined pin seated in the aligned splined barrel sleeve.

It is to be appreciated that an embodiment in which the first portion 54 and the second portion 56 are reversed from that shown in FIG. 4, biases the pin 40 to permit relative rotation of the plates 12, 14. The teeth 46*a*, 46*b* are thereby positioned in the respective second portions 56 of the sleeve bushings 22, 18, 24. The locking assembly may be locked to restrict relative rotation. This is accomplished by moving the pin 40 longitudinally against the spring 74, and if necessary, rotated, to move the teeth 46 into the channels 58.

While the embodiment illustrated in FIG. 4 involves only three (3) sleeve bushings 18, 22, 24, a typical hinge employs five (5) with two spaced-apart sleeve bushings on one plate and three spaced-apart sleeve bushings on the other plate. The sleeve bushings coaxially align in alternating sequence, and the pin 40 would be suitably lengthened for use in such embodiment.

An alternate embodiment provides for selective multi-position locked positions. This is accomplished by including in the sleeve bushing 24 additional channels 58 at selected relative angles.

Figure 7:
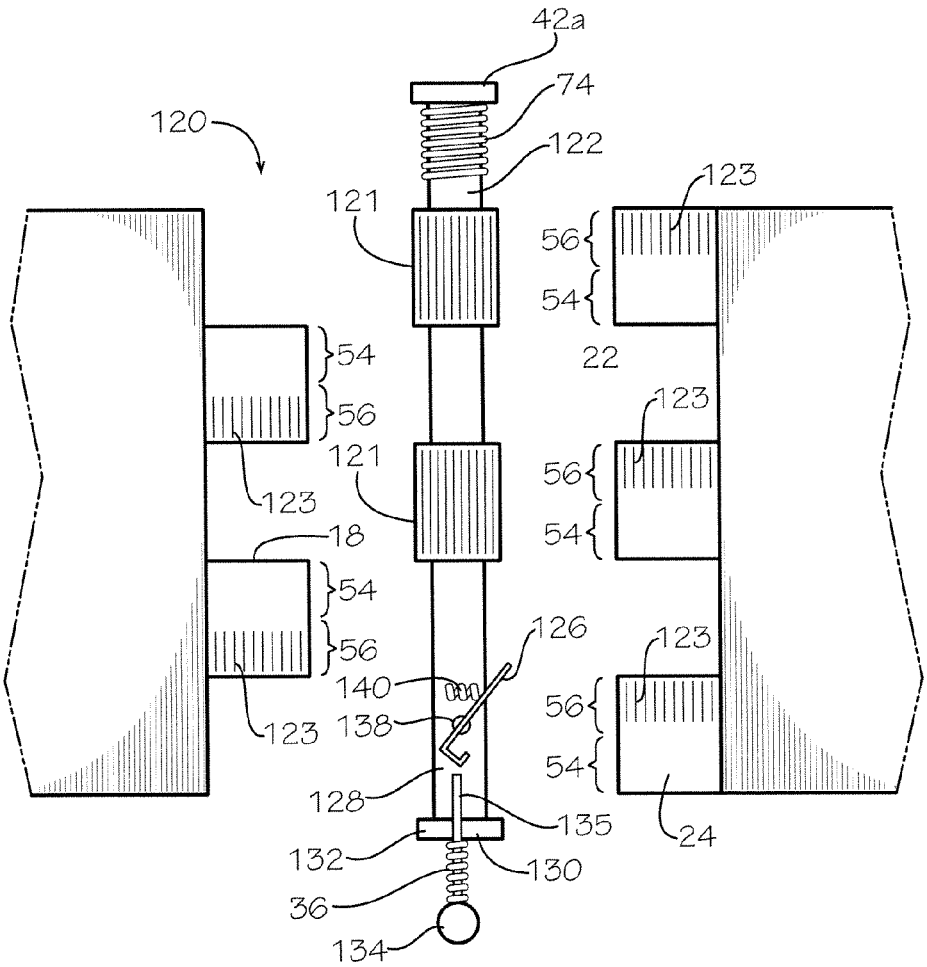
FIG. 7 illustrates in plan view an alternate embodiment of a locking hinge assembly.

FIG. 7 illustrates in plan view an alternate embodiment of a locking hinge assembly 120 using splines 121 with 20 teeth radially spaced on a pin 122 and sleeve bushings 18, 22, 24 with interior splines 123 of 20 radially spaced teeth. In this embodiment, the spring 74 seats on an upper edge of the spline 22 against the cap 42*a*. The locking assembly 120 includes an latch 126 that deploys to holds the pin 122 in the second position. In the exemplary embodiment, the pin 122 defines a passageway 128 extending longitudinally from an end closed by a screw-on cap 130 having a plunger hole 132. A plunger 134 includes a plunger arm 135 biased by a spring 136 to an outward position. The latch 126 pivotably connects with a pivot member 138 to the pin 122. The latch 126 moves between a first position received within the passageway 128 and a second position with the latch pivoted to extend though a slot outwardly of the pin 122. A distal end of the latch 126 in the second position bears against an end of the sleeve bushing 24 to hold the pin 122 relative to the sleeve bushing in the second position. A spring member 140 disposed within the channel 128 biases the latch 126 to the extended position. Moving the pin 122 from the first position to the second position releases the latch 126 to secure the pin in the second position relative to the sleeve bushing 24.

The pin 122 may be released from the secured second position in order to move the pin from the second position to the first position. This is accomplished by moving the pin 122 against the spring 74 to relieve the bearing contact of the distal end of the latch 126 on the sleeve bushing 24. The latch 126 is pressed to return the latch into the channel 128. The pin 122 is released to move to the first position. The inner wall of the sleeve busing 24 restricts the latch 126 from moving outwardly from the channel 128.

In an alternate embodiment, the pin 122 defines a channel, with the latch 126 pivotably connected at one end of the channel. A spring biases the pin outwardly. The interior wall of the sleeve bushing 24 restricts passage of the latch outwardly. Moving the pin 122 longitudinally to the second position allows the latch 126, clear from the sleeve bushing, to pivot outwardly and engage a lower edge or end of the sleeve bushing. This holds the pin 122 in the second position in the locking assembly. To return to the first position, the pin 122 is pressed in order to relieve the pressing of the latch against the sleeve bushing 24. The latch is pressed into the channel and the pin 122 released. The spring 74 returns the pin to the biased position with the splines in the second portion of the sleeve bushings for free relative rotation. An alternate embodiment (not illustrated) uses a cylinder key lock, or other key lock device, with a movable bolt as the pressing member to bear against the latch 126 for moving the latch inwardly of the channel.

With reference to FIG. 7, the spring 74 maintains the splined pin within the portion of the sleeve bushings having the major diameter, allowing for unimpeded hinge movement. It is to be appreciated that reversing the bore diameters of the sleeve bushings (i.e., switching the relative positions of the first portion 54 and the second portion 56 of the sleeve bushings) or the major diameter spline and gap portions on the splined pin, results in a "fail" open or "fail" closed configuration once the upper cap 42*a* is depressed one inch all outside splined pin locations interlock with all the passageway splines, and thereby restricting traverse or relative movement of the hinge plates.

The present invention provides a locking member that in a first position permits relative motion of two objects to which the locking member attaches and in a second position restricts relative movement of the two objects. More particularly, the present invention provides a locking assembly, comprising a sleeve defining a through passageway and having a first portion with a first inner wall surface and a second portion with a second inner wall surface. The portion of the sleeve with the first inner wall surface has a first diameter and the portion of the sleeve with the second inner wall surface has a second diameter, with the first diameter less than the second diameter. The first inner wall surface defining at least one longitudinally extending slot having opposing sidewalls and extending from a first end of the sleeve to the second wall surface. The slot defines in the first portion a diameter greater than or equal to the second diameter. An elongated pin has a longitudinal flange projecting from the pin and configured for being received selectively in the slot, whereby the sidewalls bearing on the flange restrict the pin from rotational movement relative to the sleeve. The pin movable longitudinally between a first position and an second position to dispose the pin relative to the sleeve with the flange selectively (a) in the slot in the first portion of the sleeve or (b) in the second portion. The pin is biased to have the flange in the first position.

The locking hinge assembly accordingly provides a selectively movable and lockable hinge assembly or a spline and sleeve bushing that have mechanical interactions to permit, or restrict, relative motion of barrel hinges, for use, for example in access point hardware such as residential or commercial building but may be employed in other arts, such as and without limitation, carpentry, automotive, and furniture. The locking hinge assembly has plates for securing to respective support surfaces (for example, but not limitation) a door and a door jamb, in which the sleeve bushing defines the spline in a selected portion having the major diameter (and a selected portion having a bore diameter) and receives the pin that defines the mating spline in a selected portion, with means for biasing the pin to a first position. The first position may engage the splines to restrict relative motion of the assembly. The pin being movable longitudinally to a second position removing the splines from proximate relation with the respective spline free for relative rotation. In an alternate embodiment, the pin biases to the second position.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

What is claimed is:

1. A locking hinge assembly, comprising:

a first hinge member having a hinge plate configured for attaching to a support surface and a sleeve bushing extending from an edge of the hinge plate, the sleeve bushing defining a through passageway and having a first diameter, and defining at least one tooth channel with at least opposing side walls, and open to the passageway, a second hinge member having a hinge plate configured for attaching to a second support surface and a sleeve bushing extending from an edge of the hinge plate and defining a through passageway, for co-axial alignment of the sleeve bushings;

an elongated splined pin received in the aligned sleeve bushings, the pin having a root diameter and at least one tooth projecting therefrom to define a major diameter and configured for being received selectively in the tooth channel, whereby the tooth being received in the tooth channel permits rotational movement of the sleeve barrel bushings relative to each other, until the pin is stopped by one of the side walls of the tooth channel; and a spring disposed on the pin and a cap received on the end of the pin, the spring bearing between an end of the sleeve bushing of one of the hinge members and the cap to bias the in to a first position.

2. The locking hinge assembly as recited in claim 1, wherein the pin is movable longitudinally between the first position and a second position to dispose the pin relative to the sleeve bushings with the tooth selectively in the tooth channel.

3. The locking hinge assembly as recited in claim 1, wherein the sleeve bushing has a first portion and a second portion, the first portion having the tooth channel, such that:

with the pin biased for the tooth to be received in the tooth channel, the sleeve bushings are restricted from relative rotation by the stop walls of the tooth channel and the pin movable to a second position to position the tooth in the second portion of the sleeve bushings so that the sleeve bushings may rotate relative to each other, and with the pin biased for the tooth to be received in the second portion, the sleeve bushings are free to rotate relative to each other and the pin movable to the first position to position the tooth in the tooth channel in the first portion of the sleeve bushing so that the sleeve bushings are restricted by the side walls of the tooth channel from rotating relative to each other.

4. The locking assembly as recited in claim 3, further comprising means for holding the pin in the second position.

5. The locking assembly as recited in claim 4, wherein the means for holding the pin further comprises an arm that moves from a first position recessed within the pin to a second position extending from the pin to engage an end of the sleeve bushing.

6. The locking assembly as recited in claim 5, wherein the pin defines a longitudinally extending channel that receives the arm; and the arm pivotally mounts within the channel.

7. The locking assembly as recited in claim 6, further comprising means for biasing the arm to the second position.

8. The locking assembly as recited in claim 4, wherein means for biasing comprises a spring member disposed within the channel to bias the arm to the second position with a portion of the arm outwardly of the channel, whereby moving the pin from the first position to the second position releases the arm to secure the pin in the second position.

9. The locking assembly as recited in claim 8, further comprising:

the pin defines a longitudinal passageway extending from an end of the pin into the channel;

a pressing member extending through the passageway with a first end extending from the end of the pin and a second end in contact with an end of the arm, whereby moving the arm to the second position moves the pressing member to extend from the pin and subsequently pressing the pressing member causes the arm to move to the first position so that the pin may be moved to the first position.

10. The locking assembly as recited in claim 9, wherein a first one of the caps rigidly engages the respective end of the pin and a second one of the caps threadably engages the opposing end of the pin.

11. The locking assembly as recited in claim 1, wherein the first portion of the sleeve bushing of the first hinge member is adjacent a first end thereof; and further comprising:

a second one of said sleeve bushings in which the second portion is adjacent a first end of the second one of said sleeve bushings;

the pin having a second longitudinal tooth projecting from the pin and configured for being received selectively in the tooth channel of the second one of said sleeve bushings coaxially aligned with the first sleeve bushings, whereby the side walls bearing on the second tooth restrict the pin from rotational movement relative to the first and second sleeve bushings.

12. The locking assembly as recited in claim 1, further comprising a second cap that seats on an opposing end of the pin.

13. The locking assembly as recited in claim 1, wherein the tooth channel has an arcuate width that exceeds the width of the tooth, whereby the pin has an arcuate range for relative movement limited by the opposing side walls of the channel that define stops upon contact by the tooth.

14. A locking hinge, comprising:

a first hinge plate configured for securely connecting to a first support surface and having a plurality of spaced-apart first sleeves, each sleeve defining a passageway coaxially aligned with the passageways of adjacent sleeves, and at least one of said sleeves having a first portion with a first inner wall surface and a second portion with a second inner wall surface, the first inner wall surface of the first sleeve defining a spline with a first diameter and the second inner wall surface having a second diameter less that the first diameter;

a second hinge plate configured for securely connecting to a second support surface and having a plurality of spaced-apart second sleeves, each second sleeve defining a passageway coaxially aligned with the passageways of adjacent second sleeves, and at least one of said second sleeves having a first portion with a first inner wall surface and a second portion with a second inner wall surface, the second inner wall surface of the second sleeve defining a spline with the first diameter and the first inner wall surface of the second sleeve having the second diameter less that the first diameter;

the first sleeves and the second sleeves arranged for being disposed in alternating sequence when the first hinge plate and second hinge plate are disposed with the respective sleeves coaxially aligned, the aligned sleeves disposed in alternating sequence;

a hinge pin received in the aligned passageways on which the first and the second hinge plates pivot so that the first and second support surfaces rotate relative to each other, the hinge pin defining at least a first and a second spline portion spaced-apart thereon for aligning with the first inner wall surface of the first sleeve and the second inner wall surface of the second sleeve respectively when the hinge pin is in a first position and the first and the second spline portion aligning with the second inner wall surface of the first sleeve and the first inner wall surface of the second sleeve when the hinge pin is in a second position;

means for biasing the hinge pin in the first position; and a latch movable between a first position to a second position to hold the hinge pin in the second position.

15. The locking hinge as recited in claim 14, wherein means for biasing comprises a spring received on the hinge pin and bearing against one of the sleeves to bias the hinge pin into a first position.

16. A locking hinge assembly, comprising:

a first hinge member having a hinge plate configured for attaching to a support surface and a sleeve bushing extending from an edge of the hinge plate, the sleeve bushing defining a through passageway and having a first diameter, and defining at least one tooth channel with at least opposing side walls and open to the passageway, the tooth channel having an arcuate width between opposing sides walls that define an opposing pair of stops;

a second hinge member having a hinge plate configured for attaching to a second support surface and a sleeve bushing extending from an edge of the hinge plate and defining a through passageway, for co-axial alignment of the sleeve bushings;

an elongated splined pin received in the aligned sleeve bushings, the pin having a root diameter and at least one tooth projecting therefrom to define a major diameter and configured for being received selectively in the tooth channel, the tooth having a width less than the arcuate width of the tooth channel, whereby the pin has an arcuate range for relative movement limited by the stops upon contact by the tooth, whereby the tooth being received in the tooth channel permits rotational movement of the sleeve bushings relative to each other, until the pin is stopped by one of the side walls of the tooth channel.

17. The locking hinge assembly as recited in claim 16, wherein the pin is movable longitudinally between the first position and a second position to dispose the pin relative to the sleeve bushings with the tooth selectively in the tooth channel.

18. The locking hinge assembly as recited in claim 17, further comprising a spring disposed on the pin and a cap received on the end of the pin, the spring bearing between an end of the sleeve bushing of one of the hinge members and the cap to bias the pin to the first position.

19. The locking hinge assembly as recited in claim 16, wherein the sleeve bushing has a first portion and a second portion, the first portion having the tooth channel, such that:

with the pin biased for the tooth to be received in the tooth channel, the sleeve bushings are restricted from relative rotation by the stop walls of the tooth channel and the pin movable to a second position to position the tooth in the second portion of the sleeve bushings so that the sleeve bushings may rotate relative to each other, and with the pin biased for the tooth to be received in the second portion, the sleeve bushings are free to rotate relative to each other and the pin movable to the first position to position the tooth in the tooth channel in the first portion of the sleeve bushing so that the sleeve bushings are restricted by the side walls of the tooth channel from rotating relative to each other.

20. The locking assembly as recited in claim 19, further comprising an arm that moves from a first position recessed within the pin to a second position extending from the pin to engage an end of the sleeve bushing, to hold the pin in the second position.

21. The locking assembly as recited in claim 20, wherein the pin defines a longitudinally extending channel that receives the arm; and the arm pivotally mounts within the channel.

22. The locking assembly as recited in claim 21, further comprising a spring member disposed within the channel to bias the arm to the second position.

23. The locking assembly as recited in claim 22, further comprising:

the pin defines a longitudinal passageway extending from an end of the pin into the channel;

a pressing member extending through the passageway with a first end extending from the end of the pin and a second end in contact with an end of the arm, whereby moving the arm to the second position moves the pressing member to extend from the pin and subsequently pressing the pressing member causes the arm to move to the first position so that the pin may be moved to the first position.

24. The locking assembly as recited in claim 16, wherein the first portion of the sleeve bushing of the first hinge member is adjacent a first end thereof; and further comprising:

a second one of said sleeve bushings in which the second portion is adjacent a first end of the second one of said sleeve bushings; and the pin having a second longitudinal tooth projecting from the pin and configured for being received selectively in the tooth channel of the second one of said sleeve bushings coaxially aligned with the first sleeve bushings, whereby the side walls bearing on the second tooth restrict the pin from rotational movement relative to the first and second sleeve bushings.

25. The locking assembly as recited in claim 16, further comprising a second cap that seats on an opposing end of the pin.

* * * * *